US007397456B2

(12) United States Patent
Igarashi

(10) Patent No.: US 7,397,456 B2
(45) Date of Patent: Jul. 8, 2008

(54) INSPECTING METHOD AND INSPECTING DEVICE OF CONTROL SIGNAL FOR DISPLAY DEVICE, AND DISPLAY UNIT HAVING THIS INSPECTING FUNCTION

(75) Inventor: Yoichi Igarashi, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 612 days.

(21) Appl. No.: 10/831,103

(22) Filed: Apr. 26, 2004

(65) Prior Publication Data

US 2004/0212609 A1 Oct. 28, 2004

(30) Foreign Application Priority Data

Apr. 24, 2003 (JP) ..... 2003-119771

(51) Int. Cl.
*G09G 3/36* (2006.01)

(52) U.S. Cl. ..... 345/88; 345/72

(58) Field of Classification Search ..... 345/72, 345/83, 88–98, 204, 698
See application file for complete search history.

(56) References Cited

U.S. PATENT DOCUMENTS 5,095,365 A * 3/1992 Takatoo et al. ..... 348/143
5,250,937 A * 10/1993 Kikuo et al. ..... 345/89
5,757,366 A * 5/1998 Suzuki ..... 345/213
6,603,552 B1 * 8/2003 Cline et al. ..... 356/417
7,027,025 B2 * 4/2006 Takeda ..... 345/96

* cited by examiner

*Primary Examiner*—Bipin Shalwala
*Assistant Examiner*—Jean Lesperance
(74) *Attorney, Agent, or Firm*—Antonelli, Terry, Stout & Kraus, LLP.

(57) ABSTRACT

The states of various kinds of control signals, such as a horizontal synchronizing signal, a vertical synchronizing signal, a display timing signal, etc., that are supplied from an external signal source to a display device, are inspected. In the states of various kinds of control signals supplied from the external signal source HOST to the display device DSP, (1) the vertical synchronizing signal (VSYNC) is converted into a display signal of red (R), (2) the horizontal synchronizing signal (HSYNC) is converted into a display signal of green (G), and (3) the display timing signal is converted into a display signal of blue (B) by a control signal inspecting circuit. The states are displayed in color and brightness on the screen of the display device DSP, so that these states can be simply visually inspected.

6 Claims, 10 Drawing Sheets

FIG. 10 decode 1

| LRST | pc | v1 | v0 | for R |
|---|---|---|---|---|
| 0 | 0 | * | 0 | h'00 |
| 0 | 0 | * | 0 | h'80 |
| 0 | 0 | * | 1 | h'80 |
| 0 | 0 | * | 1 | h'FF |
| 1 | 1 | 1 | * | h'FF |
| 1 | 1 | 0 | * | h'00 |
| 1 | 1 | 0 | * | h'80 |

FIG. 11 decode 2

| LRST | pc | h1 | h0 | d1 | d0 | for G |
|---|---|---|---|---|---|---|
| 0 | * | 0 | 0 | * | * | h'00 |
| 0 | * | 0 | 1 | * | * | h'80 |
| 0 | * | 1 | 0 | * | * | h'80 |
| 0 | * | 1 | 1 | * | * | h'FF |
| 1 | 1 | * | * | * | * | h'FF |
| 1 | 0 | * | * | 0 | 0 | h'00 |
| 1 | 0 | * | * | 1 | 1 | h'80 |

FIG. 12 decode 3

| LRST | pc | d1 | d0 | for B |
|---|---|---|---|---|
| 0 | * | 0 | 0 | h'00 |
| 0 | * | 0 | 1 | h'80 |
| 0 | * | 1 | 0 | h'80 |
| 0 | * | 1 | 1 | h'FF |
| 1 | 1 | * | * | h'FF |
| 1 | 0 | * | 0 | h'00 |
| 1 | 0 | * | 1 | h'80 |

INSPECTING METHOD AND INSPECTING DEVICE OF CONTROL SIGNAL FOR DISPLAY DEVICE, AND DISPLAY UNIT HAVING THIS INSPECTING FUNCTION

BACKGROUND OF THE INVENTION

The present invention relates to a flat type display device in the form of a liquid crystal panel, an organic EL panel or a plasma panel, for example, and, more particularly, the invention relates to a method of inspecting control signals for these display devices, and a display unit having this inspecting function.

In an image and screen image display unit using a flat type display device, such as a personal computer or a flat panel type television, for example, various kinds of timing signals serving as control signals for displaying a display signal (an image signal and a screen image signal) on the screen of the display device are supplied from an external signal source (HOST), such as an image processing circuit of a personal computer main body or a screen image signal processing circuit of a television receiver, etc., together with the display signal.

When there is an abnormality in the control signal inputted from the external signal source, an abnormality is produced in the screen display of the display device. An oscilloscope or a logic analyzer is conventionally used to inspect for such an abnormality of the control signal. However, there is a limit in the amount of information that is able to be stored by the oscilloscope or the logic analyzer. Further, it takes time and labor to detect whether the abnormality exists in the control signal corresponding to which location on the display screen. The measurement is easy when it is to determine whether it is an abnormality signal or not due to switching of the edge of a vertical synchronizing signal, a horizontal synchronizing signal or a display timing signal. However, it is difficult to measure in which location the abnormality exists within a certain frame.

On the other hand, in the display device of the active matrix type, such as a liquid crystal display unit of a thin film transistor type (TFT-LCD), for example, screen image information is displayed on the screen of the display device in real time, but it is impossible to display how its control signal is constructed on the screen. When a normal display is produced, no display of the control signal is required. However, when the display is abnormal, it is not easy to determine how the abnormality signal is inputted from the external signal source, even when it is possible to judge whether this abnormal display exhibits an abnormality of the screen image information or an abnormality of the control signal. Reference is made to literature 1 (JP-A-2001-109424) or literature 2 (JP-A-2001-272964), which disclose techniques for coping with a control signal abnormality of this kind.

BRIEF SUMMARY OF THE INVENTION

When the control signal inputted from a controller (a control module of the above-mentioned external signal source, a personal computer main body, etc.) is abnormal, the above-referenced techniques avoid damage to the display device, etc. by stopping the control signal from this controller. However, in using these techniques, it is impossible to determine the detailed contents of the abnormality of the control signal.

An object of the present invention is to provide a method of inspection and a device for inspection of a control signal for a display device, which make it possible to simply inspect the states of various kinds of timing signals (control signals), such as the horizontal synchronizing signal (HSYNC), the vertical synchronizing signal (VSYNC), the display timing signal (DTMG), etc., that are supplied from the external signal source to the display device, and also to provide a display unit having this inspecting function.

To achieve the foregoing object, in accordance with the present invention, the states of various kinds of timing signals (control signals) that are supplied from an external signal source to the display device are displayed in color and with a degree of brightness in the display device so that these states can be simply visually inspected. For example, (1) the vertical synchronizing signal (VSYNC) is converted into a display signal of red (R) color; (2) the horizontal synchronizing signal (HSYNC) is converted into a display signal of green (G); and (3) the display timing signal is converted into a display signal of blue (B) color. These converted display signals are displayed on the screen of the display device.

In the display in the horizontal direction, the signals of plural pixels (clock number), e.g., pixels corresponding to the timing of two clocks, four clocks or eight clocks, are displayed by one pixel as a parameter clock number of one pixel to arrange information in a horizontal blanking period in the display within one line of the display device. At this time, one pixel corresponding to a predetermined clock number is set to produce a display at the maximum brightness of a predetermined color, and an intermediate tone display is set when the clock number is smaller than the predetermined clock number. For example, when the parameter clock number for setting four clocks to one pixel is set, the green (G) is displayed in the maximum brightness of one pixel when the horizontal synchronizing signal is constructed by four pixels. When the signals of only two pixels are inputted, the display is produced at the intermediate tone brightness (brightness of two pixels), which is half the maximum brightness, of the green (G) pixel.

Further, the turn-back portion of a horizontal scanning line is set to the termination mark of a previous stage line as an input of the horizontal synchronizing signal. The pulses or more of the subsequent horizontal synchronizing signal are set to the maximum brightness of the color green (G) in the horizontal display. The (horizontal) blanking period is set to a black display. In the portion between horizontal blanking lines having pixels smaller than the plural pixels determined by the parameter clock number, a first pixel of the color green (G) representing the termination of the line is set to the intermediate tone display.

Since the display timing signal (DTMG) is completed within the line, in principle, plural pixels determined by the parameter clock number are displayed in blue (B) in this signal portion. When the horizontal synchronizing signal (HSYNC) and the display timing signal (DTMG) are overlapped, a mixed color display of green (G) and blue (B) is attained.

If the interval from a certain horizontal synchronizing signal (HSYNC) to the next horizontal synchronizing signal (HSYNC) is too short and no line processing can be completed and it is difficult to perform display processing in the display device, the horizontal synchronizing signal (HSYNC) is continuously displayed in the above-mentioned color on the screen of the display device after the certain horizontal synchronizing signal (HSYNC).

Some parameters are required in frame starting and displaying methods as the screen of the display device. With respect to these parameters, it is possible to make a selection from the exterior as follows. Namely, (a) A first line of the display on the screen of the display device is produced by the horizontal synchronizing signal (HSYNC) after the vertical synchronizing signal (VSYNC) is inputted (control signal preferential type). (b) A line including the horizontal synchronizing signal, after the input of the display timing signal (DTMG) and after the termination of the horizontal blanking period, is set to the first line display on the screen of the display device (display preferential type). (c) A line (means the start of a vertical blanking period) on which the display timing signal (DTMG) has vanished is set to the first line display on the screen of the display device (blanking period preferential type). (d) With respect to the above-mentioned conditions (a) and (b), after the generation of a trigger of the frame start, it is also possible to add a parameter for giving instructions to designate after what line the frame starting display is produced on the screen of the display device.

When one frame is displayed on the screen of the display device, no information relating to all frames can be displayed on the screen of the display device in any starting parameter in the display device normally used. However, if the present invention is applied to a display device having a resolution higher than that of the display device normally used, such information relating to all of the frames can be displayed. When such a display is produced on the screen of the display device normally used, the display of all of the information is impossible in principle. However, when the pulse of the vertical synchronizing signal (VSYNC) is abnormal or the input line number of the display timing signal (DTMG) is small or zero, all of the information can be displayed on the screen of the display device.

It is possible to cope with the case in which it is not possible to display information of all of the frames on the screen of the display device by setting a "thinning-out" display mode for selecting and displaying one of an odd line and an even line for every one line in the display period. Whether the thinning-out of the line is performed or not greatly depends on the contents of the control signal abnormality. Accordingly, the thinning-out of the line is set so as to be selected. There are specifications of positive and negative polarities in the vertical synchronizing signal (VSYNC) and the horizontal synchronizing signal (HSYNC). Accordingly, the vertical synchronizing signal (VSYNC) and the horizontal synchronizing signal (HSYNC) are also set by parameters, or are set so as to be selected by adopting an automatic polarity recognizing function.

The present invention has a control signal inspecting circuit in a timing controller (so-called Tcon) in a display controller for producing a display in the display device as a device for realizing the above-mentioned inspecting method.

FIG. 1 is a block diagram of the control signal inspecting circuit in accordance with the present invention. In FIG. 1, the control signal inspecting circuit CSS has a plural-pixel counting means (counter PCTR) for counting pixels corresponding to a parameter clock number, a decoder DT for converting a control signal (horizontal synchronizing signal HSYNC, vertical synchronizing signal VSYNC and display timing signal DTMG) into red (R) data, green (G) data and blue (B) data, and a line memory LM having a capacity of about the resolution of the display device in its horizontal direction for storing output data of the decoder DCT in accordance with the state of the control signal.

Further, the control signal inspecting circuit CSS has a delay circuit DT for delaying the vertical synchronizing signal VSYNC, the horizontal synchronizing signal HSYNC and the display timing signal DTMG serving as the control signal by constant times, and a shift register SR having the capacity of parameter clocks for storing the delayed control signals. The output data of this shift register SR are respectively converted into red (R) data, the green (G) data and the blue (B) data by the decoder DCR, and this data is stored to the line memory LM.

Further, the control signal inspecting circuit CSS has an address counter ACTR for designating the address of an input port when the output data of the decoder DCR is stored in the line memory LM. The control signal inspecting circuit CSS also has an end register ERGR for storing a final address of the address counter ACTR and a start counter SCTR for designating an output address of the line memory LM in accordance with the content of the end register ERGR. A data control circuit DSR is arranged on the output side of the line memory LM. The data control circuit DSR compares the content of the address counter ACTR and the end register ERGR, and it selects the red (R) data, the green (G) data and the blue (B) data outputted to a signal line driver of the display device DSP and its brightness in response to its comparison result.

Further, the control signal inspecting circuit CSS has an interval check circuit ICR for detecting the number of clocks from a certain horizontal synchronizing signal HSYNC to the next horizontal synchronizing signal HSYNC, and it performs generation and non-generation of a line reset signal LRST. When the line reset signal LRST is generated, the plural-pixel counter PCTR is cleared by this line reset signal, and the end register ERGR and the start counter SCTR are latched.

An abnormality of the control signal can be easily determined by this construction. When the timing of the control signal is changed between frames (an abnormality is generated), the display of this changing portion is darkened on the screen of the display device and flashing is produced. Thus, it is clear in which portion the control signal is changed on the screen of the display device. Further, the timing change between lines is also indicated by the length of the line display on the screen of the display device.

In the foregoing explanation, the construction is arranged as one portion of the function of the timing controller in the display controller. However, the construction having this function also can be set to an inspecting device (control signal inspecting device) using a dedicated display device independent of the display device which serves as an object. In this case, as mentioned above, the information of all of the frames can be displayed by setting a display device for the inspection of the resolution higher than that of the display device which serves as an object.

BRIEF DESCRIPTION OF THE SEVERAL VIEWS OF THE DRAWING

FIG. 10 is a table which shows decode contents of a decoder DCR1 for red (R) constituting a decoder DCR.

FIG. 11 is a table which shows decode contents of a decoder DCR2 for green (G) constituting the decoder DCR.

FIG. 12 is a table which shows decode contents of a decoder DCR3 for blue (B) constituting the decoder DCR.

DETAILED DESCRIPTION OF THE INVENTION

Figure 1:
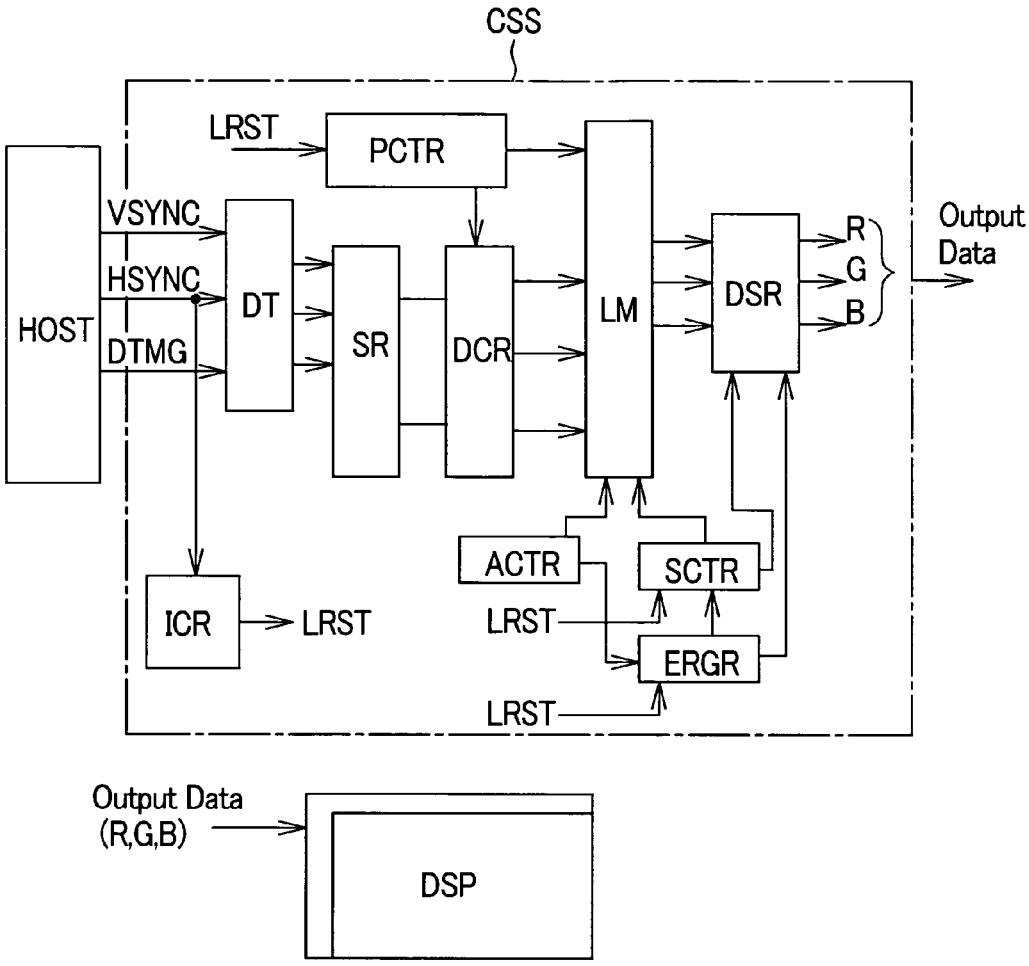
FIG. 1 is a block diagram of a control signal inspecting circuit in the present invention.
Figure 2:
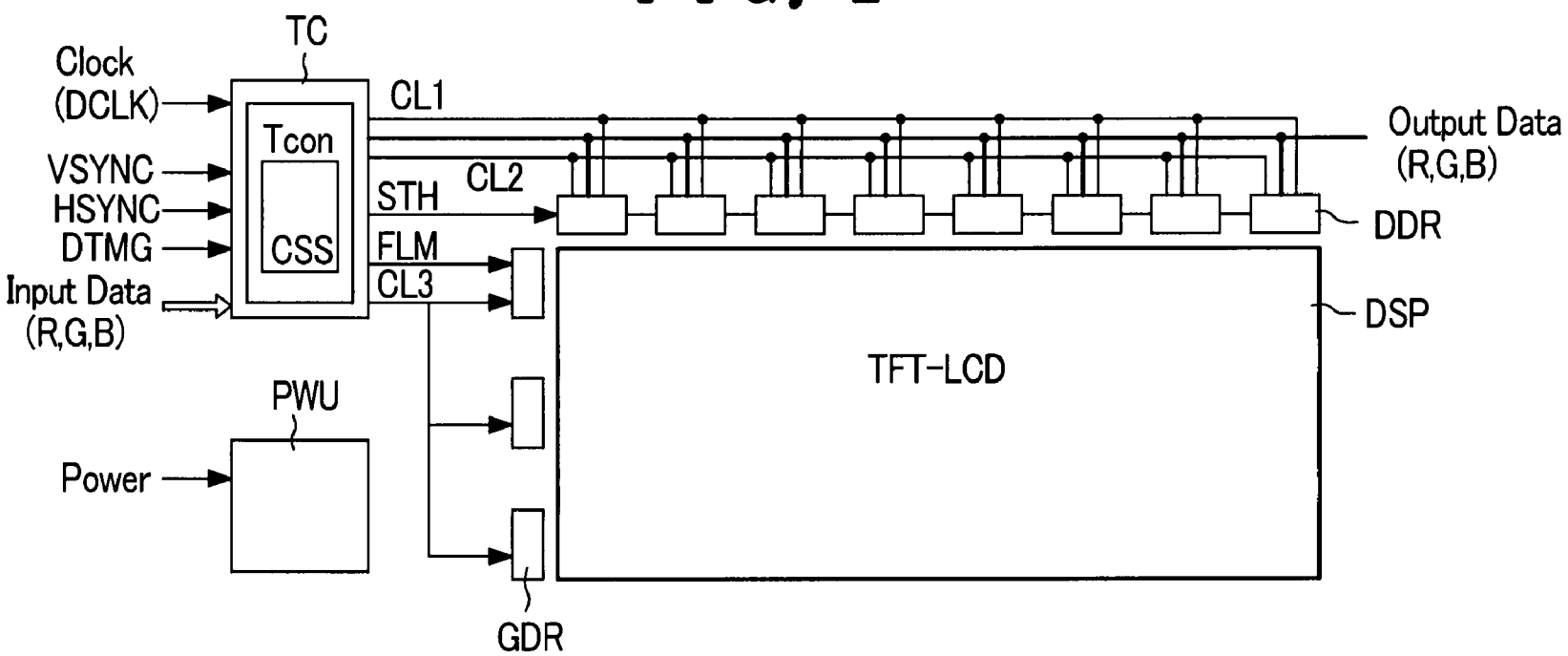
FIG. 2 is a block diagram of the overall construction of an embodiment of a display device in accordance with the present invention with a liquid crystal display unit using a liquid crystal panel serving as an example.
Figure 3:
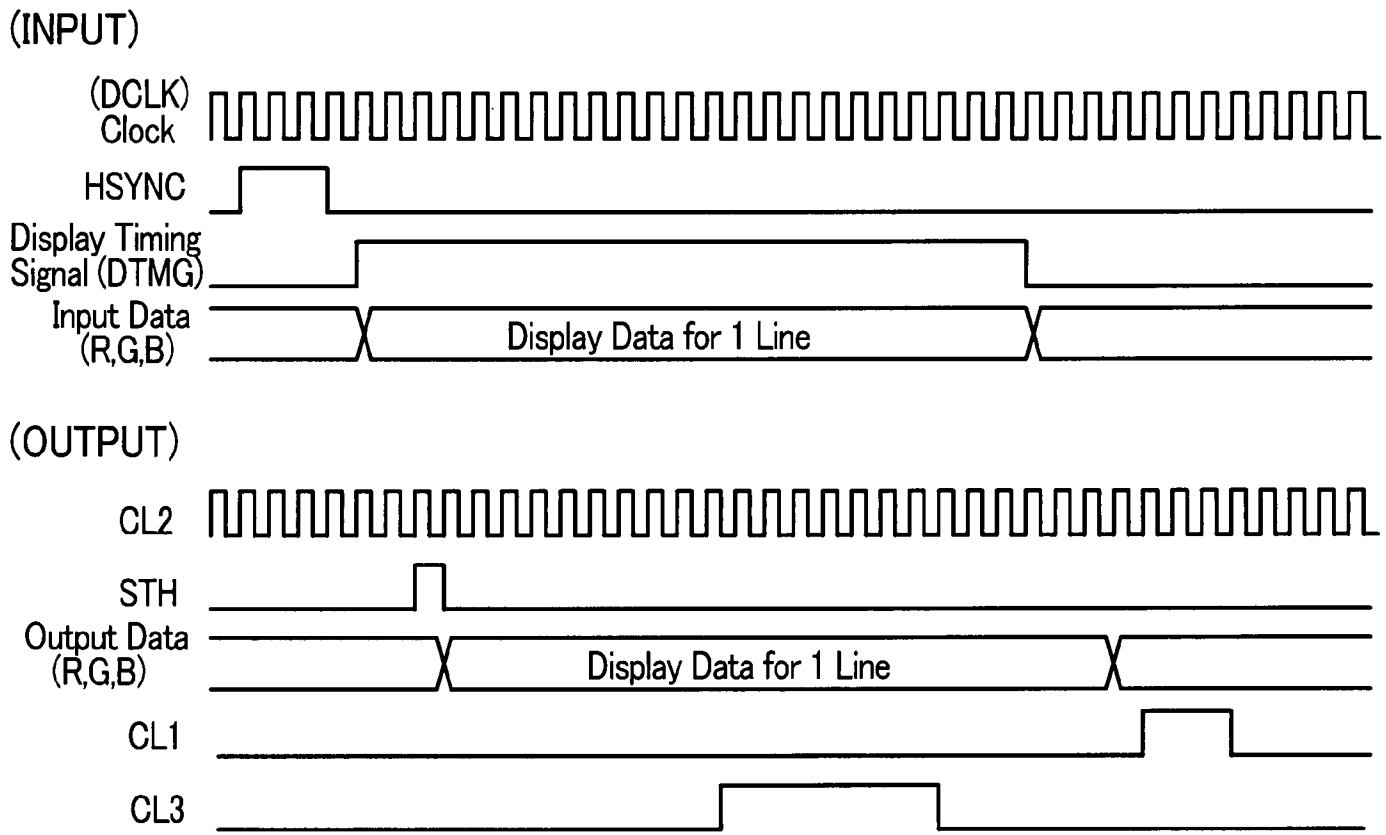
FIG. 3 is a basic waveform chart of horizontal direction operation timing of a control signal for operating the liquid crystal display unit shown in FIG. 2.
Figure 4:
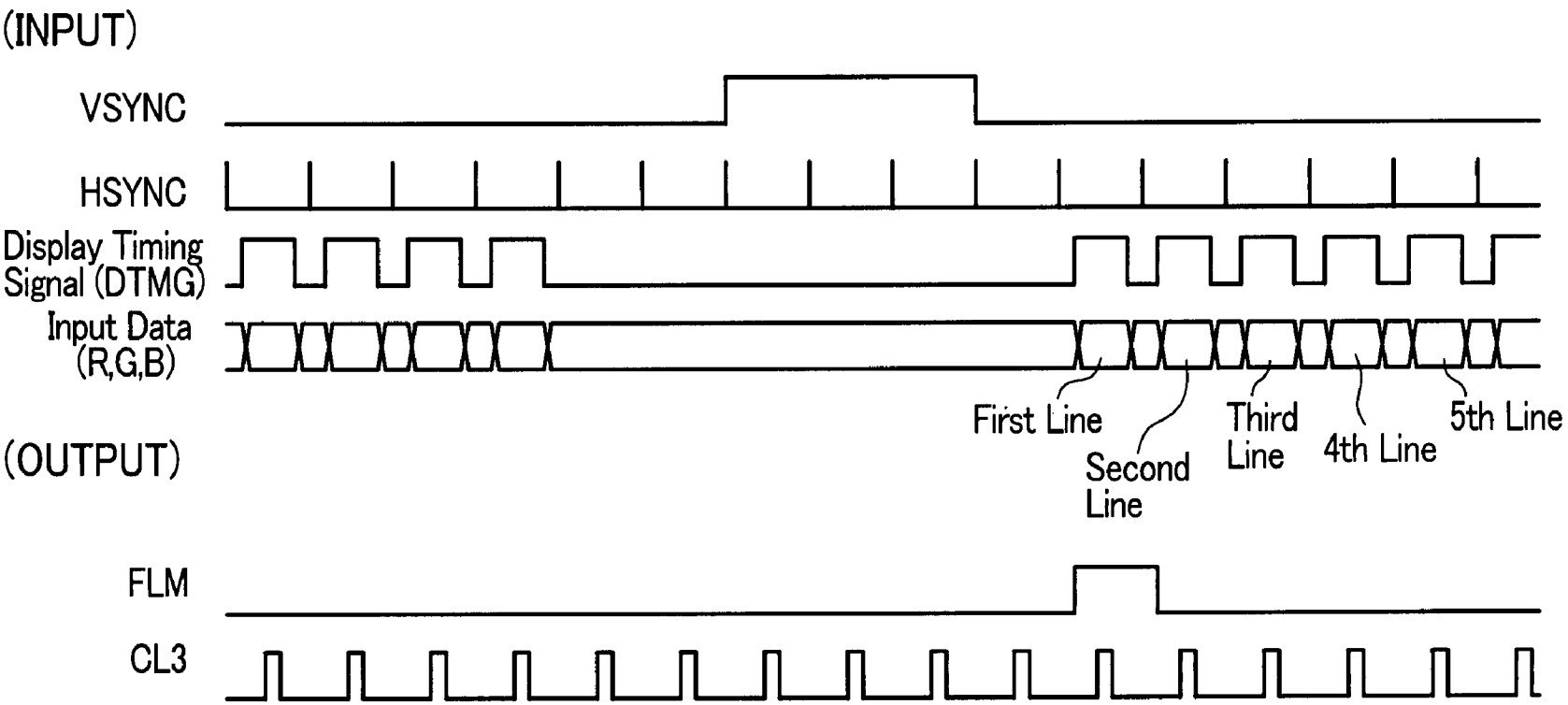
FIG. 4 is a basic waveform chart of vertical direction operation timing of the control signal for operating the liquid crystal display unit shown in FIG. 2.

Various embodiments of the present invention will be explained in detail with reference to the drawings. FIG. 2 is a block diagram of the construction of a display device in accordance with the present invention, with a display unit using a liquid crystal panel serving as an example. However, the present invention is not limited to a liquid crystal display unit using a liquid crystal panel, but also can be applied to a display unit using a display device for performing a similar operation to produce a display. FIGS. 3 and 4 are basic operation waveform charts of a control signal for operating the liquid crystal display unit shown in FIG. 2, where FIG. 3 shows the waveform chart of horizontal direction operation timing and FIG. 4 shows the waveform chart of vertical direction operation timing.

The construction of FIG. 2 will be explained with reference to FIGS. 3 and 4. First, in FIG. 2, reference numerals TFT-LCD and TC respectively designate a liquid crystal panel operating as a display device DSP and a display controller. The liquid crystal panel TFT-LCD has a plurality of gate lines arranged in the horizontal direction and a plurality of drain lines arranged in the vertical direction. The liquid crystal panel TFT-LCD has a gate-driver GDR operating as a scan driving circuit for supplying a scanning signal to the gate lines, and it also has a drain-driver DDR operating as a data driving circuit for supplying display data (output data) to the drain lines. A timing controller Tcon is arranged in the display controller TC.

The timing controller Tcon has a control signal inspecting circuit CSS having a control signal inspecting function for performing display data processing for inspecting a control signal abnormality, as will be described later, in addition to a function for performing normal display processing. An example of the operation in the normal display function of the liquid crystal panel will be explained before the operation of this control signal inspecting circuit CSS is explained. As shown in FIGS. 3 and 4, a pixel clock CL1 for applying display data (output data) from the drain-driver DDR to the drain line, a shift clock CL2 for fetching the output data to the plural drain-drivers DDR, a gate shift clock CL3 for fetching the scanning signal (gate signal) from the plural gate drivers GDR to the gate line, a line starting signal (a signal for recognizing data as first data) STH of the drain-driver, and a frame starting signal FLM of the liquid crystal panel TFT-LCD are outputted on the basis of a clock DCLK (pixel clock), a vertical synchronizing signal VSYNC, a horizontal synchronizing signal HSYNC, a display timing signal DTMG, and input data of three colors (display signal: red (R), green (G) and blue (B)) inputted from a signal source, such as a personal computer, a screen image signal processing circuit, etc.

With respect to the input data (R, G and B) and the output data (R, G and B), the amount of data in one pixel per one clock of the clock DCLK (pixel clock) is outputted as the display data of one line. The power circuit PWU serves for generating various kinds of voltages required to operate the liquid crystal display unit from electric power Power supplied from the signal source side.

Figure 5:
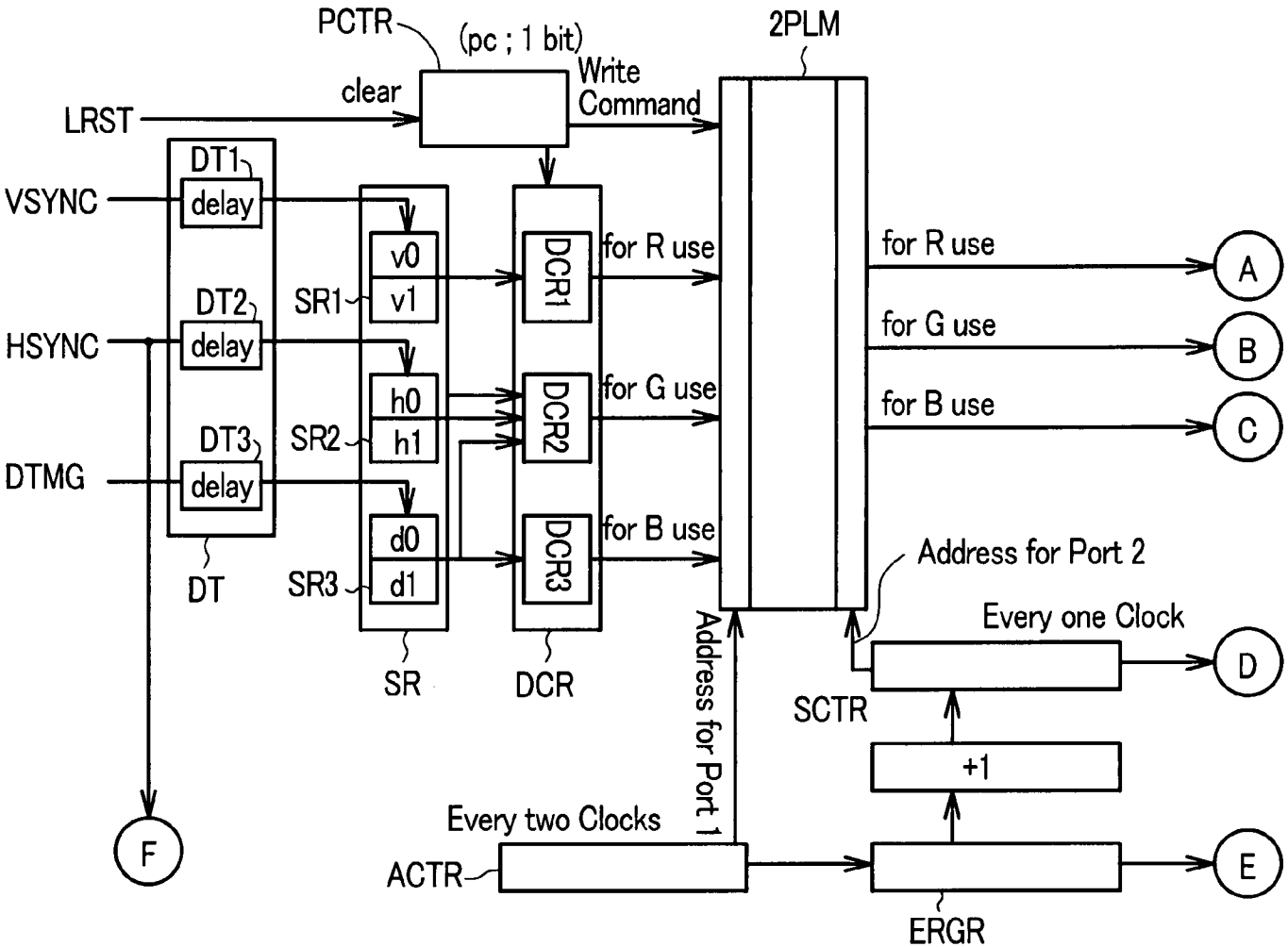
FIG. 5 is a block diagram showing an example of the control signal inspecting circuit arranged in a timing controller for realizing a method of inspection of the control signal for the display device of the present invention.
Figure 6:
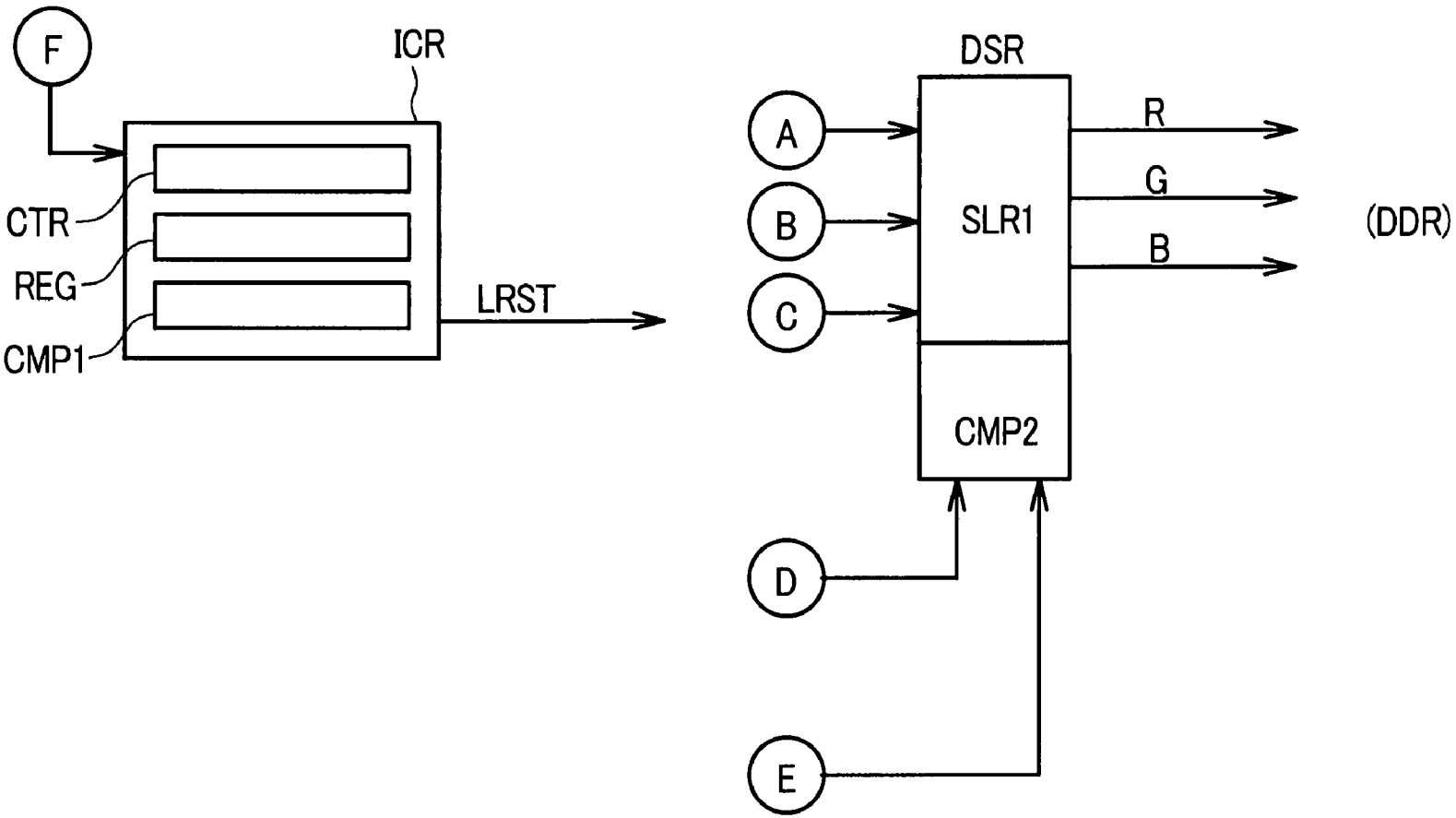
FIG. 6 is a diagram showing an example of the control signal inspecting circuit arranged in the timing controller for realizing the method of inspection of the control signal for the display device of the present invention, and is to be viewed together with FIG. 5.

FIGS. 5 and 6 are block diagrams which show an example of the control signal inspecting circuit CSS that is arranged in the timing controller for realizing the method of inspection of a control signal for the display device of the present invention. Reference characters A to F surrounded by O of FIG. 5 are connected to the same reference characters A to F in FIG. 6. The timing controller Tcon has a line memory 2PLM having the capacity of about the resolution of the liquid crystal panel TFT-LCD (FIG. 2) in its horizontal direction and which stores the output data of a decoder in accordance with the state of the control signal. This line memory 2PLM is a 2-port memory having two ports, including an input port and an output port.

In this embodiment, as will be explained below, the number (pc) of parameter clocks of one pixel is set to 2. This timing controller Tcon has a plural-pixel counter PCTR for counting pixels corresponding to the parameter clock number "2", and it also has a decoder DCR for converting the control signal (the horizontal synchronizing signal HSYNC, the vertical synchronizing signal VSYNC and the display timing signal DTMG) into red (R), green (G) and blue (B) data. This decoder DCR is constructed from a decoder DCR1 for red (R) data, a decoder DCR2 for green (G) data, and a decoder DCR3 for blue (B) data.

The decode contents of the decoder DCR1 for red (R) data, the decoder DCR2 for green (G) data and the decoder DCR3 for blue (B) data, constituting the decoder DCR, are shown in FIG. 10 (decode1), FIG. 11 (decode2) and FIG. 12 (decoder3), respectively.

In FIGS. 10 to 12, the designations LRST and pc respectively designate a line reset signal and a parameter clock number. Designations v1, v0 designate the contents of a shift register SR-1 (a state of the vertical synchronizing signal). Designations h1, h0 designate the contents of a shift register SR-2 (a state of the horizontal synchronizing signal). Designations d1, d0 designate the contents of a shift register SR-3 (a state of the display timing signal). Designations '1' and '0' respectively designate high and low levels. Symbol "*" designates one of '0' and '1'. Data for red (R), green (G) and blue (B) are outputted from the decoder DCR1, the decoder DCR2 and the decoder DCR3 to the line memory 2PLM on the basis of the contents of the shift registers SR-1, SR-2, SR-3 in accordance with the existence of an input in the line reset signal.

In this embodiment, there are an address counter ACTR, an end register ERGR and a start counter SCTR. The address counter ACTR designates the address of an input port when each decode output data of the decoder DCR is stored to the line memory 2PLM. The end register ERGR stores a final address of the address counter ACTR. The start counter SCTR designates an output address of the line memory 2PLM in accordance with the data stored in the end register ERGR. The start counter SCTR and the end register ERGR perform latching operations in time with the line reset signal LRST. A data control circuit DSR is arranged on the output side of the line memory 2PLM. The data control circuit DSR compares the stored data of the address counter ACTR and the end register ERGR, and it selects display color data (red (R), green (G) and blue (B)) and its brightness outputted to the drain-driver DDR (FIG. 2) of the display device by its comparison result. The data control circuit DSR includes a selector SLR1 and a comparing section CMP2. The comparing section CMP2 compares the value of the start counter SCTR and that of the end register ERGR. The selector SLR1 outputs the contents of the line memory 2PLM in the case of (start counter)≦(end register). In the case of (start counter)>(end register), the selector SLR1 performs a control operation such that red (R) is shown at maximum brightness and green (G) and blue (B) are not displayed.

Further, the present invention calls for an interval check circuit ICR for performing generation and non-generation of the line reset signal LRST by detecting the number of clocks from a certain horizontal synchronizing signal HSYNC to the next horizontal synchronizing signal HSYNC. When the line reset signal is generated, the plural-pixel counter PCTR is cleared by this line reset signal LRST, and the end register ERGR and the start counter SCTR are latched. The interval check circuit ICR detects the number of clocks from the horizontal synchronizing signal HSYNC to the next horizontal synchronizing signal HSYNC, and it outputs no line reset signal when the clock interval is too short.

Figure 7:
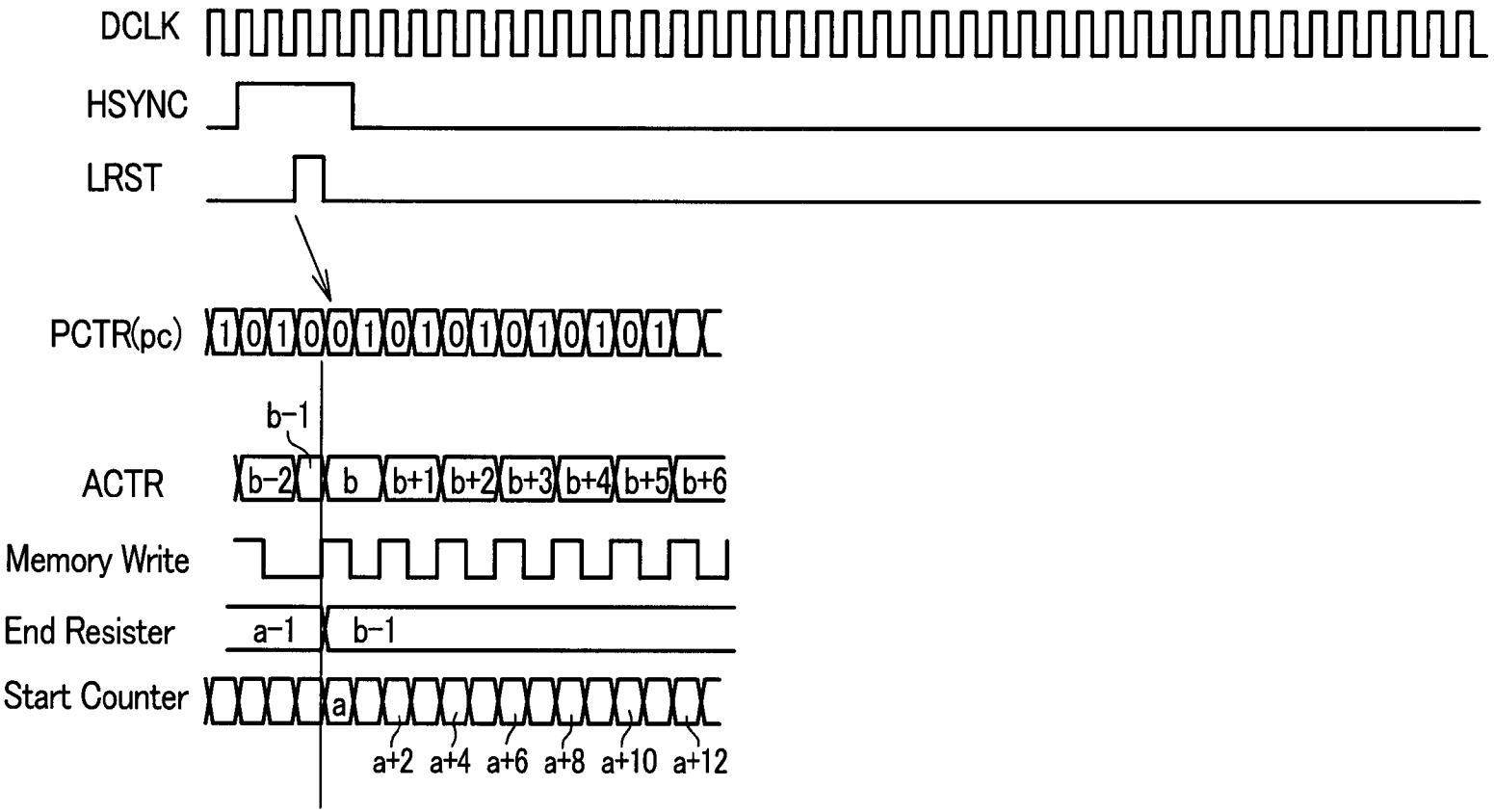
FIG. 7 is an operation waveform chart illustrating the operation of the control signal inspecting circuit in the embodiment of the present invention shown in FIGS. 5 and 6.

FIG. 7 is an operation waveform chart illustrating the operation of the control signal inspecting circuit in the embodiment of the present invention shown in FIGS. 5 and 6. The operations of the constructions of FIGS. 5 and 6 will be explained in detail with reference to FIGS. 7 and 10 to 12.

In the constructions of FIGS. 5 and 6, the line memory 2PLM clears the plural-pixel counter PCTR, with the horizontal synchronizing signal HSYNC serving as a reference, and it counts a pulse number "2" of the horizontal synchronizing signal HSYNC on the basis of the inputted clock signal. The plural-pixel amount (maximum brightness) of green (G) data is stored in the line memory 2PLM for every counted pulse number "2" of the horizontal synchronizing signal HSYNC. When the pulse of the horizontal synchronizing signal HSYNC has only one pixel amount, data of half the brightness of the green (G) data is stored. When the input of the horizontal synchronizing signal HSYNC has vanished, black data is stored in the memory portion for green (G) data.

When no display timing signal DTMG is inputted ('0': low level), black data is stored to the portion for blue (B) data. When the display timing signal DTMG is inputted ('1': high level), the black data is stored to the portion for blue (B) in a unit of two pixels along the plural-pixel parameter "2". In the case of the vertical synchronizing signal VSYNC, red (R) data is similarly set to the line memory 2PLM. Similar to the other signals, data is stored in the line memory 2PLM even when the vertical synchronizing signal VSYNC is inputted.

The output of a signal to the liquid crystal panel is started when the next horizontal synchronizing signal HSYNC is inputted. The plural-pixel parameter counter PCTR at this time is checked. In the case of "1", the signal states of the vertical synchronizing signal VSYNC and the display timing signal DTMG are checked and the corresponding data shown as follows is stored. Namely, (a) there is the vertical synchronizing signal VSYNC,
½ gradation data of red (R)

(b) there is the display timing signal DTMG,
½ gradation data of blue (B)

(c) there is no display timing signal DTMG,
½ gradation data of green (G).

Here, (a) shows an independent event and (b) and (c) show exclusion events.

At this time, it is stored how the data of what pixel amount is stored into the line memory 2PLM by its address setting. The above-described data storage processing is continued as it is for the next line.

In the output processing to the liquid crystal panel, after the next horizontal synchronizing signal HSYNC is inputted, the previously stored data is read from the beginning in the address setting order and is outputted to the drain-driver of the liquid crystal panel together with the shift clock CL2. A line starting signal STH of the drain-driver is outputted prior to the data to recognize the data as first data. After all of the stored data is read and sent to the drain-driver, maximum brightness data for red (R) is sent to the drain-driver. After the data of transversal resolution (horizontal resolution) is outputted to the drain-driver, the clock CL1 for outputting this data to the drain line of the liquid crystal panel is sent to the drain-driver. The gate shift clock CL3 is outputted during this line processing. In a line thinning-out mode, after this processing is performed by one line, a stopping state is next attained.

When the interval from a certain horizontal synchronizing signal HSYNC to the next horizontal synchronizing signal HSYNC is too short, for example, when there is a CL1 output that is unable to complete the line processing of the liquid crystal panel, no line switching processing is performed, and the next line data is set to data in extension processing of this line.

The plural-pixel counter PCTR of FIG. 7 shows a case in which the clock number of one line at a previous stage is odd. With respect to a memory write operation, FIG. 7 shows a case in which the memory write operation is continuously generated twice.

Figure 8:
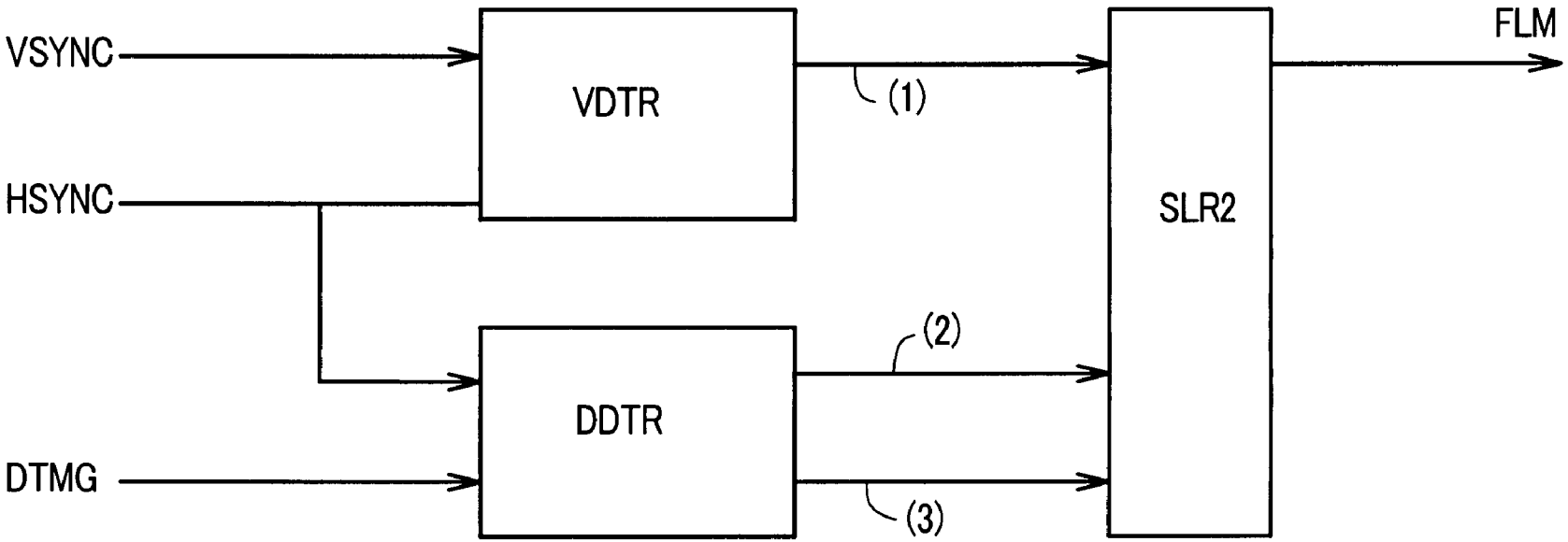
FIG. 8 is a block diagram of a construction for performing frame starting signal processing in the embodiment of the present invention.

FIG. 8 is a block diagram showing a construction for performing frame starting signal processing in the embodiment of the present invention. This construction is constituted by a vertical synchronizing signal VSYNC detecting circuit VDTR, a display timing signal DTMG detecting circuit DDTR and a selecting circuit SLR2.

Figure 9:
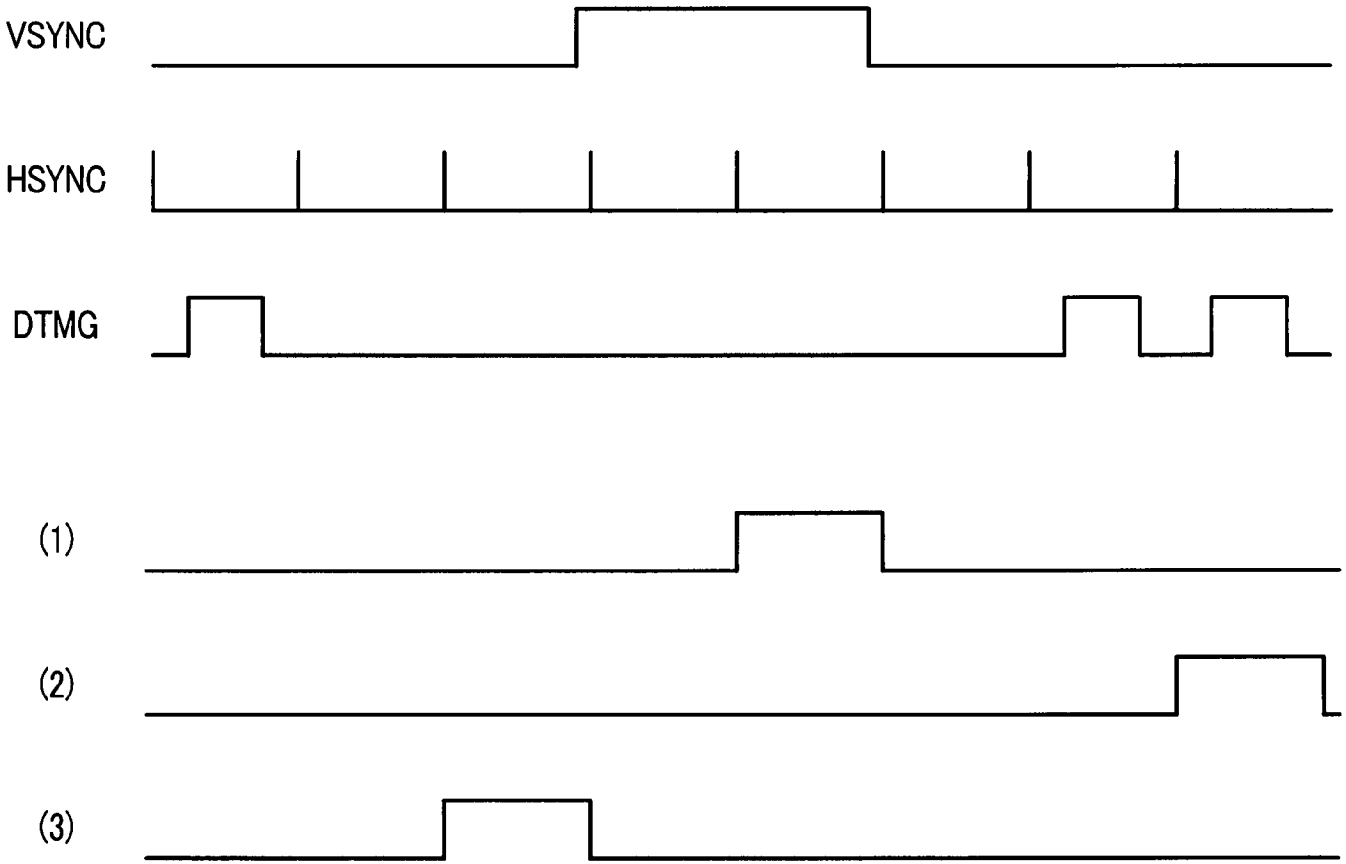
FIG. 9 is an operation waveform chart for the construction of FIG. 8.

FIG. 9 is an operation waveform chart relating to the system of FIG. 8. A frame starting signal FLM output to the liquid crystal panel is determined by respective parameters, which will be explained below, in accordance with (1) a control signal preferential mode, (2) a display preferential mode, and (3) a blanking period preferential mode. Namely, (1) in the control signal preferential mode, the selecting circuit SLR2 outputs the frame starting signal FLM by the next horizontal synchronizing signal HSYNC in which the input of the vertical synchronizing signal VSYNC is detected by the vertical synchronizing signal detecting circuit VDTR. (2) In the display preferential mode and (3) in the blanking period preferential mode, when there is no display timing signal DTMG between the horizontal synchronizing signal HSYNC and the next horizontal synchronizing signal HSYNC in the display timing signal detecting circuit (DTMG detecting circuit) DDTR, this case is judged as a vertical blanking period. In the blanking period preferential mode, the frame starting signal FLM is outputted when output processing of the liquid crystal display panel is started using the trigger of the second horizontal synchronizing signal HSYNC. When it is judged once as the vertical blanking period and the display timing signal DTMG is then inputted and the display preferential mode is set, the frame starting signal FLM is outputted at the output starting time of the liquid crystal display panel using the trigger of the next horizontal synchronizing signal HSYNC after the input of the display timing signal DTMG.

The abnormality of the control signal can be easily seen on the screen of the liquid crystal panel by the construction of this embodiment, as explained above. When the timing of the control signal is changed between frames (an abnormality is generated), the display of the changing portion is darkened on the screen of the display device and flashing is produced. Thus, it is clear in which portion of the screen the control signal is changed. Further, the timing change between lines is determined by the length of the line display on the screen of the display device. When there is a control signal abnormality that is unable to be displayed in the construction of the present invention (e.g., clock un-input, abnormality generation/un-input of the horizontal synchronizing signal HSYNC), the display is disturbed at random, and a DC component is applied and an after-image is generated in the case of the liquid crystal display panel. However, such an abnormality can be easily measured by using the conventional oscilloscope or logic analyzer.

In the above explanation, the construction is arranged as one portion of the function of the timing controller in the display controller. However, the construction having this function can be also set to a dedicated display device (control signal inspecting device) independent of the display device as an object. In this case, as mentioned above, information of all frames can be displayed by setting the display device for inspection of a resolution higher than that of the display device as an object.

Further, the line memory is not limited to a 2-port memory 2PLM having input and output ports, but also can be constructed such that two one-port memories are used and are alternately used for every line. When two one-port memories are used, a final stored address is memorized and is reflected in the output processing to the display device. More specifically, when memory writing processing is performed until then in the line starting processing (at the inputting time of the horizontal synchronizing signal HSYNC), the contents of the address counter ACTR are stored to its own end register ERGR and the address counter ACTR stores '0' (showing address 0) and memory reading processing is performed. When the memory reading processing is performed until then at the line starting processing time, the address counter ACTR is set to '0' and the memory writing processing is performed.

As explained above, the present invention has a delay circuit for delaying the vertical synchronizing signal, the horizontal synchronizing signal and the display timing signal as control signals by constant times, and a shift register having the capacity of parameter clocks is provided for storing the delayed control signals. The output data of the shift register are respectively converted into red (R), green (G) and blue (B) data by the decoder and are stored in the line memory. The stored data is displayed on the screen of the display device. Thus, the abnormality of the control signal can be easily known from the contents visually displayed on the screen of the display device.

What is claimed is:

1. A control signal inspecting device for a display device for displaying an indication of the existence of an abnormality of plural control signals inputted from an external signal source on the screen of the display device, comprising:

a display device for inspection at a resolution equal to or higher than that of said display device; and a display controller having a timing controller having a control signal inspecting circuit for generating control signals including a horizontal synchronizing signal, a vertical synchronizing signal and a display timing signal on the basis of various kinds of synchronizing signals inputted from said external signal source, wherein said control signal inspecting circuit has:

a plural-pixel counter for setting a clock corresponding to plural pixels determined in advance to a parameter clock, and counting the pixels corresponding to the number of parameter clocks;

a decoder for converting each of the horizontal synchronizing signal, the vertical synchronizing signal and the display timing signal as said control signals into red (R) data, green (G) data and blue (B) data;

a delay circuit for delaying each of said control signals by a constant time;

a shift register having the capacity of said parameter clocks for storing each of said control signals delayed by said delay circuit;

a line memory having the capacity of about the resolution of said display device for inspection in the horizontal direction, and respectively converting output data of said shift register into red (R) data, green (G) data and blue (B) data by said decoder and storing the converted data;

an address counter for designating the address of an input port when each output data of said decoder are stored to said line memory;

an end register for storing a final address of said address counter;

a start counter for designating an output address of said line memory in accordance with the stored data of said end register; and a data control circuit arranged on the output side of said line memory and comparing the stored data of said address counter and said end register, and selecting the red (R) data, the green (G) data and the blue (B) data outputted to said display device and its brightness by the comparison result.

2. The control signal inspecting device according to claim 1, wherein said control signal inspecting circuit further has an interval check circuit for detecting the number of clocks from a horizontal synchronizing signal to the next horizontal synchronizing signal, and performing generation and non-generation of a line reset signal.

3. A display unit comprising:

a display controller having a timing controller having a control signal inspecting circuit for generating control signals including a horizontal synchronizing signal, a vertical synchronizing signal and a display timing signal;

a decoder for converting each of said horizontal synchronizing signal, said vertical synchronizing signal and said display timing signal into one of red (R) data, green (G) data and blue (B) data;

a display device for displaying the converted data;

a delay circuit for delaying the output of said control signal;

a line memory for storing the data converted by said decoder;

wherein said display controller has a plural-pixel counter for setting a clock corresponding to plural pixels determined in advance to a parameter clock, and counting the pixels corresponding to the parameter clock number;

a shift register having a capacity of said parameter clocks;

an address counter for designating the address of an input port when each output data of said decoder are stored to said line memory;

an end register for storing a final address of said address counter;

a start counter for designating an output address of said line memory in accordance with the stored data of said end register; and a data control circuit arranged on the output side of said line memory and comparing the stored data of said address counter and said end register and selecting the red (R) data, the green (G) data and the blue (B) data and its brightness outputted to said display device by the comparison result.

4. The display unit according to claim 3, wherein output data switching means for switching normal display data and display data from said control signal inspecting circuit is arranged in said timing controller.

5. The display unit according to claim 3, wherein said display controller generates the control signal including the horizontal synchronizing signal, the vertical synchronizing signal and the display timing signal on the basis of various kinds of synchronizing signals inputted from the exterior.

6. The display unit according to claim 3, wherein the states of said horizontal synchronizing signal, said vertical synchronizing signal and said display timing signal are displayed by changing the brightnesses of the red (R) data, the green (G) data and the blue (B) data.

* * * * *